United States Patent [19]

Knapp et al.

[11] 4,214,565

[45] Jul. 29, 1980

[54] FUEL INJECTION APPARATUS

[75] Inventors: Heinrich Knapp, Leonberg; Thomas Wilfert, Markgröningen; Alfred Grässle, Ludwigsburg; Paul Füssner, Sindelfingen, all of Fed. Rep. of Germany

[73] Assignee: Robert Bosch GmbH, Stuttgart, Fed. Rep. of Germany

[21] Appl. No.: 937,882

[22] Filed: Aug. 29, 1978

[30] Foreign Application Priority Data

Oct. 5, 1977 [DE] Fed. Rep. of Germany ..... 2744733

[51] Int. Cl.[2] ..... F02M 39/02; F02M 1/00

[52] U.S. Cl. ..... 123/179 L; 123/445; 123/179 G; 261/50 A; 261/39 E

[58] Field of Search ..... 123/179 L, 179 G, 139 AW, 123/139 BG, 119 F; 261/50 A, 39 E

[56] References Cited

U.S. PATENT DOCUMENTS

| | | | |
|---|---|---|---|
| 3,613,650 | 10/1971 | Stumpp et al. | 123/139 BG |
| 4,132,211 | 1/1979 | Wilfert et al. | 123/179 L |
| 4,136,653 | 1/1979 | Knapp et al. | 123/139 AW |

FOREIGN PATENT DOCUMENTS

| | | | |
|---|---|---|---|
| 2344701 | 3/1975 | Fed. Rep. of Germany | 123/179 L |
| 2444800 | 4/1976 | Fed. Rep. of Germany | 123/139 AW |
| 2460094 | 6/1976 | Fed. Rep. of Germany | 123/139 AW |
| 1223925 | 3/1971 | United Kingdom | 123/179 G |

*Primary Examiner*—P. S. Lall
*Attorney, Agent, or Firm*—Edwin E. Greigg

[57] ABSTRACT

A fuel injection apparatus for mixture-compressing, externally ignited internal combustion engines. An air flow rate member, arranged in the air intake manifold is moved against a return force by air flowing through it to adjust a control slide of a metering and distribution assembly arranged in the fuel supply line in order to effect the apportionment of a quantity of fuel which is proportional to the air quantity. The return force is produced by a pressure fluid acting upon the control slide, the pressure of the fluid being variable in accordance with operating characteristics of the internal combustion engine. The control slide has an actuation slide contacting the air flow rate member as well as an apportionment slide, which has a projection with a smaller diameter projecting into an axial throttle bore of the actuation slide and defining a damping space in the throttle bore. The damping space is in communication with the fuel supply line via a gap between the projection and the throttle bore, and there is a bimetallic spring arranged between the apportionment slide and the actuation slide. By this means a richer fuel-air mixture is controlled at the metering and distribution assembly in accordance with the starting temperature, during starting of the engine below a predetermined temperature; the enrichment is lessened after the start in accordance with both temperature and time.

4 Claims, 2 Drawing Figures

FUEL INJECTION APPARATUS

BACKGROUND OF THE INVENTION

The invention relates to a pressure control valve to be used in a fuel injection system for a mixture-compressing internal combustion engine. A fuel injection apparatus of this type is already known in which the stop characterizing the rest position of the air flow rate member is adjustably embodied in accordance with the temperature of the internal combustion engine. This apparatus has the disadvantage, however, that at increasing rpm during the engine start the enrichment of the fuel-air mixture is continuously lessened, since the air flow rate member and thus the control slide of the metering and distribution assembly is already displaced into the opening position by the temperature-dependent stop, until the air flow rate member lifts from the stop and no further starting enrichment takes place. In contrast to this, to effect positive starting of the internal combustion engine, the ideal enrichment of the fuel-air mixture which is sought is one which remains as constant as possible in relation to the rpm during starting.

OBJECT AND SUMMARY OF THE INVENTION

The fuel injection apparatus according to the invention has the advantage over the prior art that in accordance with the starting temperature below approximately +30° C. an enrichment of the fuel-air mixture is produced which remains constant in relation to the rpm during starting, while at the same time the enrichment of the fuel-air mixture is lessened in accordance with temperature and time, so that on the one hand a positive warm-up of the internal combustion engine is accomplished but immediately after starting a lessening of the toxic exhaust gas components is effected. The dependent claims present further advantageous embodiments of the invention.

The invention will be better understood as well as further objects and advantages thereof become more apparent from the ensuing detailed description of preferred embodiments taken in conjunction with the drawings.

DESCRIPTION OF THE PREFERRED EMBODIMENT

Figure 1:
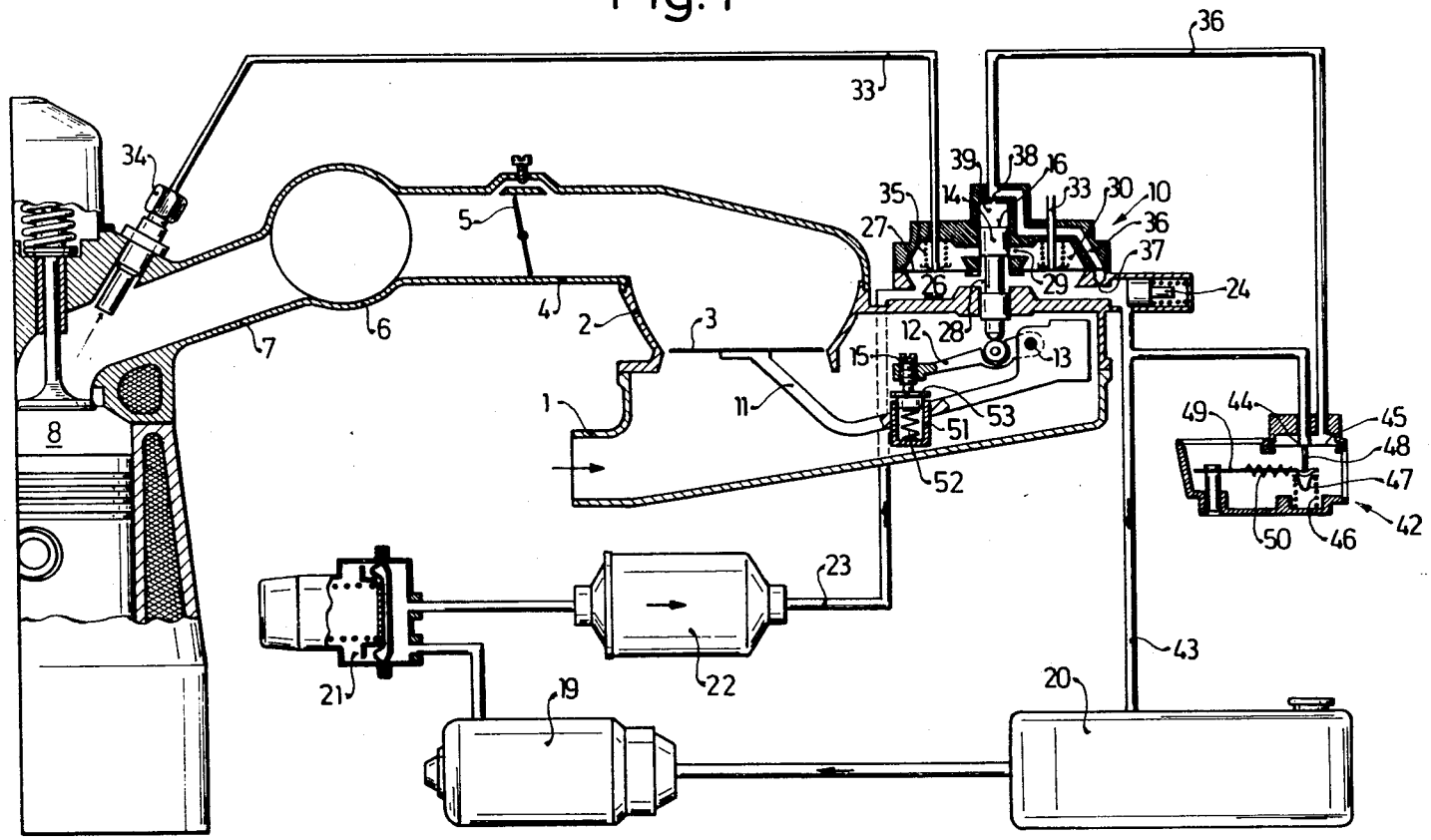
FIG. 1 is a first exemplary embodiment of the fuel injection apparatus with cold-start control.

Turning now to FIG. 1, there will be seen a fuel injection system including an intake manifold 1 having a conical section 2 which contains an air flow rate member 3 beyond which there is located an induction tube region 4 containing an arbitrarily settable throttle valve 5. Intake air flows through the induction tube in the direction of the arrow to a manifold 6 from which it is directed to individual induction tube regions 7 to one or more cylinders 8 of an internal combustion engine.

In the present case, the air flow rate member 3 is a baffle plate disposed transversely with respect to the direction of air flow and capable of displacement within the conical region 2 of the induction tube as an approximately linear function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11 which is pivoted on the same shaft 13 as a correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate member 3 and acts as a return force in opposition to the force of the flowing air.

Fuel is supplied by an electric fuel pump 19 which aspirates fuel from a fuel tank 20 and delivers it through a storage container 21, a filter 22 and a fuel line 23 to the fuel metering and distribution assembly 10. A fuel system pressure controller 24 maintains the system pressure in the fuel injection system constant.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees permitting fuel to flow into chambers 30 which are divided from the chambers 26 by the diaphragm 27. From the chambers 30, fuel flows through the injection channels 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes defined, in each case, by a chamber 26 and a chamber 30, insure that the pressure drop at the metering valve 28, 29 is substantially constant independently of the relative overlap between the annular groove 28 and the control slits 29, i.e., independently of the fuel quantity flowing to the injection valves 34. This insures that the metered out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end of the control slide 14 extends.

The control pressure line 36 contains a control pressure valve 42 which permits control fluid to return to the fuel tank 20 via a return line 43 without pressure. The control pressure valve 42 permits changing the pressure which produces the restoring force during the warm-up of the engine in dependence on time and temperature. The control pressure valve 42 is a flat seat valve having a fixed valve seat 44 and a diaphragm 45 which is loaded in the closure direction by a spring 46.

The spring 46 acts via a spring support 47 and a transmission pin 48 onto the diaphragm 45. When the engine temperature is below the normal operating temperature a first bimetallic spring 49 acts in opposition to the force of the spring 46. The bimetallic spring 49 carries an electric heater 50, the operation of which after starting causes a diminution of the force of the bimetallic spring 49 on the spring 46, and by this means the control pressure in the control pressure line 36 increases.

In order to accomplish secure starting of the internal combustion engine at engine starting temperatures below approximately 30° C., a capsule 51 is connected with the operating lever 11 in which a compression spring 52 is supported whose other end contacts the mixture control screw 15 of the correction lever 12 via a spring plate 53. The compression spring 52 is so designed that at starting temperatures above approximately 30° C., the return force on the control slide 14 produced by the pressure fluid suffices to overcome the force of the compression spring 52 and to bring the spring plate 53 into contact with the capsule 51, so that the compression spring 52 has no further influence on the fuel apportionment. At starting temperatures below approximately 30° C., the force of the compression spring 52 is greater than the force of the pressure fluid on the control slide 14, since the control pressure valve 42 in the control pressure line 36 regulates a more limited control pressure, so that the compression spring 52 displaces the correction lever 12 and thereby the control slide 14 opposite the air flow rate member 3 in the direction of an increase of the apportioned fuel quantity. With an increasing operating temperature of the internal combustion engine, an increasing pressure in the control pressure line 36 is likewise controlled by means of the pressure control valve 42, so that as a result of the increasing return force on the control slide 14 the spring plate 53 is increasingly displaced in the direction of the capsule 51, until it is in contact therewith. The arrangement of the compression spring 52 between the operating lever 11 and the correction lever 12 makes possible by simple means an enrichment of the fuel-air mixture at starting temperatures below approximately 30° C. and insures a secure warm-up of the internal combustion engine. A further temperature-dependent effect on the fuel-air mixture during starting can be achieved through the embodiment of the compression spring 52 as a bimetallic spring.

Figure 2:
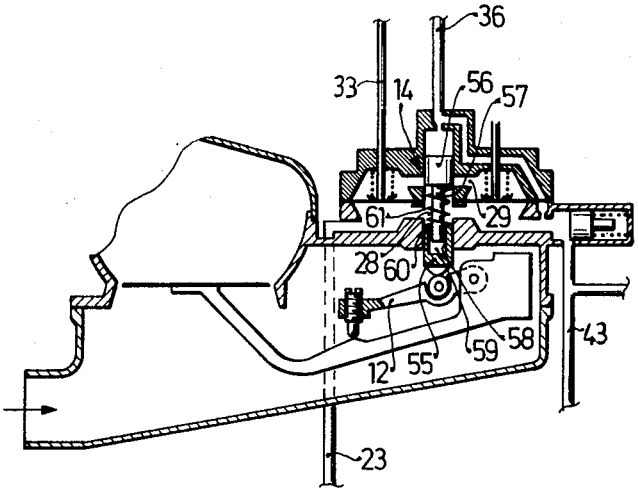
FIG. 2 is a second exemplary embodiment of the fuel injection apparatus with cold-start control.

In the second exemplary embodiment according to FIG. 2, the control slide 14 has an actuation slide 55 contacting the correction lever 12 and further has an apportionment slide 56. The apportionment slide 56 has a projection 57 of a smaller diameter, which projects into an axial throttle bore 58 of the actuation slide 55 and defines a damping space 59 in the throttle bore 58. The damping space 59 communicates across a gap 60 between the projection 57 and the throttle bore 58 with the annular groove 28 formed by the projection 57 and thus with the fuel supply line 23. Coaxially with the projection 57, a bimetallic spring 61 is arranged between the apportionment slide 56 and the actuation slide 55. By this means it is further accomplished that at starting temperatures below approximately 30° C. the bimetallic spring 61 displaces the apportionment slide 56 opposite to the air metering device in the direction of a greater opening of the control slit 29, so that a richer fuel-air mixture is produced during starting at lower temperatures. If the control pressure in the control pressure line 36 rises during starting, and thus the return force on the control slide 14 increases, then the displacement toward each other of the apportionment slide 56 and the actuation slide 55 takes place in a hydraulically damped fashion as a result of the slow rate of flow of fuel across the gap 60 from the damping space 59, so that a temporary control of the starting enrichment is produced.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for mixture-compressing, externally ignited internal combustion engines with an induction tube in which an air flow rate member and an arbitrarily actuatable throttle valve are arranged in seriatim and the air flow rate member is moved against a return force in accordance with the quantity of air flowing therethrough, thus adjusting a control slide embodied as a movable part of a metering and distribution assembly arranged in the fuel supply line in order to effect the apportionment of a quantity of fuel proportional to the air quantity, characterized in that transmission means including a compression spring are provided between said control slide and said air flow rate meter and wherein the control slide of the metering and distribution assembly opposite the air flow rate member is displaceable in accordance with temperature.

2. A fuel injection apparatus according to claim 1, further wherein said compression spring is supported on said operating lever of the air flow rate member, said operating lever further including an end portion that cooperates with a correction lever and by means of which said control slide of said metering and distribution assembly is actuatable and the return force is produced through the pressure fluid acting on said control slide and the pressure of said fluid is variable in accordance with operating characteristics of the internal combustion engine.

3. A fuel injection apparatus according to claim 2, characterized in that the compression spring is embodied as a bimetallic spring.

4. A fuel injection apparatus according to claim 1, further wherein said control slide further includes an actuation slide which contacts said air flow rate member and still further includes an apportionment slide means of limited diameter which projects into an axial throttle bore provided in said actuation slide to thereby define a damping space in said throttle bore, said throttle bore arranged to communicate with said fuel supply line across a gap provided between said apportionment slide means and said throttle bore and further that said compression spring comprises a bimetallic spring arranged between the apportionment slide means and the actuation slide.

* * * * *